US010030469B2

(12) United States Patent
Williams et al.

(10) Patent No.: US 10,030,469 B2
(45) Date of Patent: Jul. 24, 2018

(54) SELF-LOCKING EXPANDABLE SEAL ACTIVATOR

(71) Applicant: BAKER HUGHES INCORPORATED, Houston, TX (US)

(72) Inventors: Jeffrey C. Williams, Cypress, TX (US); Benjamin T. Ronck, Houston, TX (US); Ziping Hu, Katy, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 664 days.

(21) Appl. No.: 14/496,712

(22) Filed: Sep. 25, 2014

(65) Prior Publication Data

US 2015/0330177 A1 Nov. 19, 2015

Related U.S. Application Data

(63) Continuation-in-part of application No. 14/276,496, filed on May 13, 2014.

(51) Int. Cl.
*E21B 33/129* (2006.01)
*E21B 33/128* (2006.01)
*E21B 23/01* (2006.01)

(52) U.S. Cl.
CPC ..... *E21B 33/1291* (2013.01); *E21B 23/01* (2013.01); *E21B 33/128* (2013.01); *E21B 33/129* (2013.01)

(58) Field of Classification Search
CPC .... E21B 23/01; E21B 33/1291; E21B 33/129; E21B 33/128
See application file for complete search history.

(56) References Cited

U.S. PATENT DOCUMENTS

| | | | | |
|---|---|---|---|---|
| 6,564,870 | B1 | 5/2003 | Grigsby et al. | |
| 6,715,560 | B2 * | 4/2004 | Doane | E21B 23/01 166/122 |
| 7,017,669 | B2 | 3/2006 | Johnston et al. | |
| 7,124,826 | B2 | 10/2006 | Simpson | |
| 7,124,829 | B2 | 10/2006 | Braddick | |
| 7,367,404 | B2 | 5/2008 | Simpson et al. | |
| 7,661,470 | B2 | 2/2010 | Doane et al. | |
| 7,779,924 | B2 | 8/2010 | Clemens et al. | |
| 7,784,797 | B2 | 8/2010 | Baugh et al. | |
| 7,954,516 | B2 | 6/2011 | Hallundbaek | |
| 8,109,340 | B2 * | 2/2012 | Doane | E21B 33/128 166/138 |
| 2012/0097384 | A1 * | 4/2012 | Valencia | E21B 33/129 166/134 |

* cited by examiner

*Primary Examiner* — Nicole Coy
(74) *Attorney, Agent, or Firm* — Steve Rosenblatt

(57) ABSTRACT

An expandable anchor/seal is pushed up a ramp until making contact with the surrounding tubular as or after the anchor/seal contacts the same tubular. The setting sleeve is made from high yield steel that has a weakened leading end to reduce the force required to push the leading end and the anchor/seal and an outer surface treatment at a leading end that engages or penetrates the wall of the surrounding tubular. Preferably a plurality of fingers are formed with axially oriented slots starting from a leading end allowing fingers to flex as they ride up the ramp on the mandrel for setting the anchor/seal and locking that set with the setting sleeve exterior surface configuration that can abut or penetrate the surrounding tubular.

21 Claims, 5 Drawing Sheets

SELF-LOCKING EXPANDABLE SEAL ACTIVATOR

CROSS REFERENCE TO RELATED APPLICATION

This application is a continuation-in-part of U.S. patent application Ser. No. 14/276,496, filed on May 13, 2014, and claims the benefit of priority from the aforementioned application.

FIELD OF THE INVENTION

The field of this invention is expandable seals that are anchored and more particularly a setting sleeve that locks to the surrounding tubular when the seal/anchor has been expanded to engage the surrounding tubular.

BACKGROUND OF THE INVENTION

Expandable seals/anchors have been described in U.S. Pat. No. 7,784,797. These designs were ring shapes of a relatively soft material that were pushed up a ramp surface to engage a surrounding tubular. One optional feature on such a design was the use of hardened buttons for penetration into the surrounding tubular. The buttons were disposed in an offset location from extending ribs that would also engage the surrounding tubular and could also optionally penetrate the tubular wall for additional anchoring. Seal material was disposed between ribs.

The issue that developed with this design was that although the anchoring feature into the wall of the surrounding tubular was adequate to retain the seal the small dimension of the carbide buttons limited the grip force on the assembly. Beyond that, the carbide buttons were mounted on a body that was relatively soft to reduce the required force for expansion of the seal assembly. Thus the ability of the carbide buttons to transmit an anchoring force to the mandrel were somewhat attenuated due to the relatively short intervening layer of the seal ring body.

Other expandable seals/anchors are described in U.S. Pat. Nos. 7,124,826; 7,367,404; 7,017,669; 6,564,870; 7,661,470; 7,367,404; 7,124,829; 7,954,516 and 7,779,924.

Another issue with the known design is that the setting sleeve was made of a relatively soft material to reduce the needed pushing force to get the sleeve to go up a ramped mandrel surface with the seal/anchor assembly to achieve the set position. These setting sleeves in the past were a cylindrical shape that had to also enlarge as it was pushed up the ramp. As a result relatively low yield steel structures were used for the setting sleeve. Such soft materials were not optimal in transferring an anchor force directly to the mandrel and in the past were not at all used for such function since the outer dimension on riding up the mandrel ramp was dimensioned to avoid engaging the surrounding tubular wall.

The present invention uses high yield steel for the setting sleeve and puts a weakening feature at the leading end to control the force needed to push the setting sleeve up the mandrel ramp. In one embodiment, a series of end axial slots are used to create a plurality of fingers that flex easily as they are driven up the ramp. These leading end fingers have a surface treatment on the exterior face that is designed to contact the surrounding tubular wall as or after the seal assembly ahead of the setting sleeve contacts the same surrounding tubular. The surface treatment can be wickers, hard particles or a roughening of the exterior surface in some other way. As a result the set position of the anchor/seal assembly is further locked in with the setting sleeve exterior surface wither abutting or penetrating the wall of the surrounding tubular at the same or a later time as the anchor/seal assembly making contact with the same tubular. These and other features of the present invention will be more readily apparent to those skilled in the art from a review of the description of the preferred embodiment and the associated drawings while understanding that the full scope of the invention is to be determined from the appended claims.

SUMMARY OF THE INVENTION

An expandable anchor/seal is pushed up a ramp until making contact with the surrounding tubular as or after the anchor/seal contacts the same tubular. The setting sleeve is made from high yield steel that has a weakened leading end to reduce the force required to push the leading end and the anchor/seal and an outer surface treatment at a leading end that engages or penetrates the wall of the surrounding tubular. Preferably a plurality of fingers are formed with axially oriented slots starting from a leading end allowing fingers to flex as they ride up the ramp on the mandrel for setting the anchor/seal and locking that set with the setting sleeve exterior surface configuration that can abut or penetrate the surrounding tubular.

DETAILED DESCRIPTION OF THE PREFERRED EMBODIMENT

Figure 1:
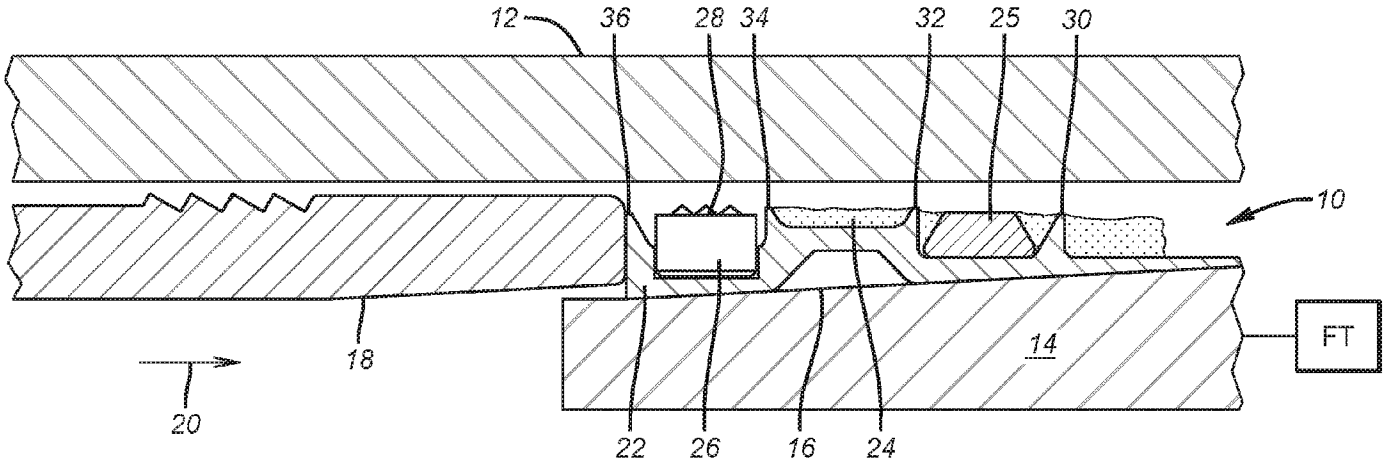
FIG. 1 is a section view in the run in position before the anchor/seal is pushed up a ramp by the setting sleeve.

FIG. 1 illustrates an anchor/seal assembly 10 akin to that patented in U.S. Pat. No. 7,784,797. As used herein, anchor/seal assembly is intended to refer to either anchors or seals or combinations thereof as well as to other devices set by expansion against a surrounding tubular. The assembly 10 is deployed in a surrounding tubular 12 on a tool that is schematically depicted as 14 where the ramped mandrel surface 16 is illustrated which is located at an end of a first tubular FT. As in the referenced patent the setting sleeve 18 moves in the direction of arrow 20 which causes the base ring 22 to move up ramp 16 to the FIG. 2 position where contact is made with the surrounding tubular 12. As previously disclosed, ring 22 has one or more sealing elements 24 and one or more rows of rounded buttons 26 with hard particles or carbide 28 on an exterior face. A travel stop 25 can be embedded in one of the sealing elements 24 to limit the radial outward movement of the anchor/seal assembly 10. The ring 22 also has a series of spaced circumferential ribs 30, 32, 34 and 36 in between which reside the sealing elements 24 and the optional buttons 26 as well as the optional travel stop 25. The ribs 30, 32, 34 and 36 can abut or penetrate the tubular 12 in the FIG. 2 set position.

The present invention adapts the setting sleeve 18 to be made of a high yield steel, instead of previously used low yield steel that was selected to limit the degree of force to get the old design to go up ramp 16. Instead, the leading end 38 has a plurality of fingers 40 defined by axial slots 42 that end in drilled holes 43 to reduce stress that may otherwise start cracks in the setting sleeve 44. At the leading end 38 the fingers 40 have an outer face 46 with a surface treatment 48. In the illustrated embodiment there are circumferentially oriented essentially parallel ribs 50 and, optionally, three rows of carbide buttons 52 also arranged circumferentially. The ribs 50 can have hardened ends 54 or the ends can just be the high yield steel used for the setting sleeve 18. The ends 54 can penetrate tubular 12 or simply abut tubular 12 in the set position of FIG. 2. Buttons 52 will generally penetrate the wall of the tubular 12. Buttons 52 can be in a variety of arrangements or a random pattern and can also be replaced with a matrix that binds hard particles. Ribs 50 can be axially oriented so they are at 90 degrees to the orientation shown in FIG. 3 or they can take other orientations in between. The ribs 50 can be continuous from opposed ends of fingers 40 or discontinuous in segments. They can be parallel or intersecting or can approach or deviate away from each other without intersection. Ideally, as the setting sleeve 44 advances into contact with the tubular 12 at of shortly after the seal 24 makes contact with tubular 12. In this manner the anchoring and sealing of the assembly 10 is locked in with the setting sleeve 44 wedged into the tubular 12 when riding up ramp 16. Since ramp 16 is part of the mandrel of the assembly 10, a radial reaction force is transmitted from the tubular 12 through the high yield steel that is preferably used for the setting sleeve 44 and into the mandrel, a part of which defines the ramp 16. Thus, not only does the surface treatment 48 retain the set of the assembly 10 but it also transfers a retaining force through a high yield material of the setting sleeve 44 into the mandrel for the assembly 10. This improves the ability of the assembly 10 to stay put in operation as the mandrel that supports it now has an independent loading location directly from the tubular 12 through the high yield material of the setting sleeve 44. Sleeve 44 does not need to have uniformity of material and the high yield portion can be just at the fingers 40. Other patterns can be used to make the end 38 less resistant to expansion force when being pushed up ramp 16. There can be scores that open into slots 42 as movement up the ramp takes place. The surface treatment 48 can be on a retained dog in a window that gets pushed through the window by riding over a ramp projection.

Apart from the issue of locking in the set when actuating an expansion operated tool so as to prevent subsequent relative movement, there is an independent concern regarding controlling the degree of applied expansion force so as to avoid damage to the surrounding tubular against which the tool in question is set. Applying too much expansion force can cause the surrounding tubular to stress crack or fail completely. This would require an expensive overhaul and lost production or a delay in production. What is envisioned to address this problem is shown in the context of a tubing string hanger/seal but is applicable for any subterranean tool that is set by expansion. What is envisioned in a tool that requires radial movement to set is an ability for parts to move relatively on an inclined surface with deliberately designed minimal resistance to radial outward movement. At some degree of radial movement that is predetermined the resistance to expansion rises dramatically to limit further radial movement. In the preferred embodiment this can be done with flexible collets that can ride up a ramp to a point where a support ring for those collets has an internal profile that matches the ramp angle engage the ramp. Since the support ring is a solid annularly shaped member the force required to push that shape up a ramp is suddenly increased as compared to pushing the collets up a ramp to in turn push a hanger/seal, for example, up the same ramp. The result is that the added force required for further movement is noticed at the surface and the expansion effort stops or, alternatively, the setting tool simply stalls as the travel stop engages the ramp at a point before too much radial movement of the tool can cause damage to the surrounding tubular that is engaged.

Figure 3:
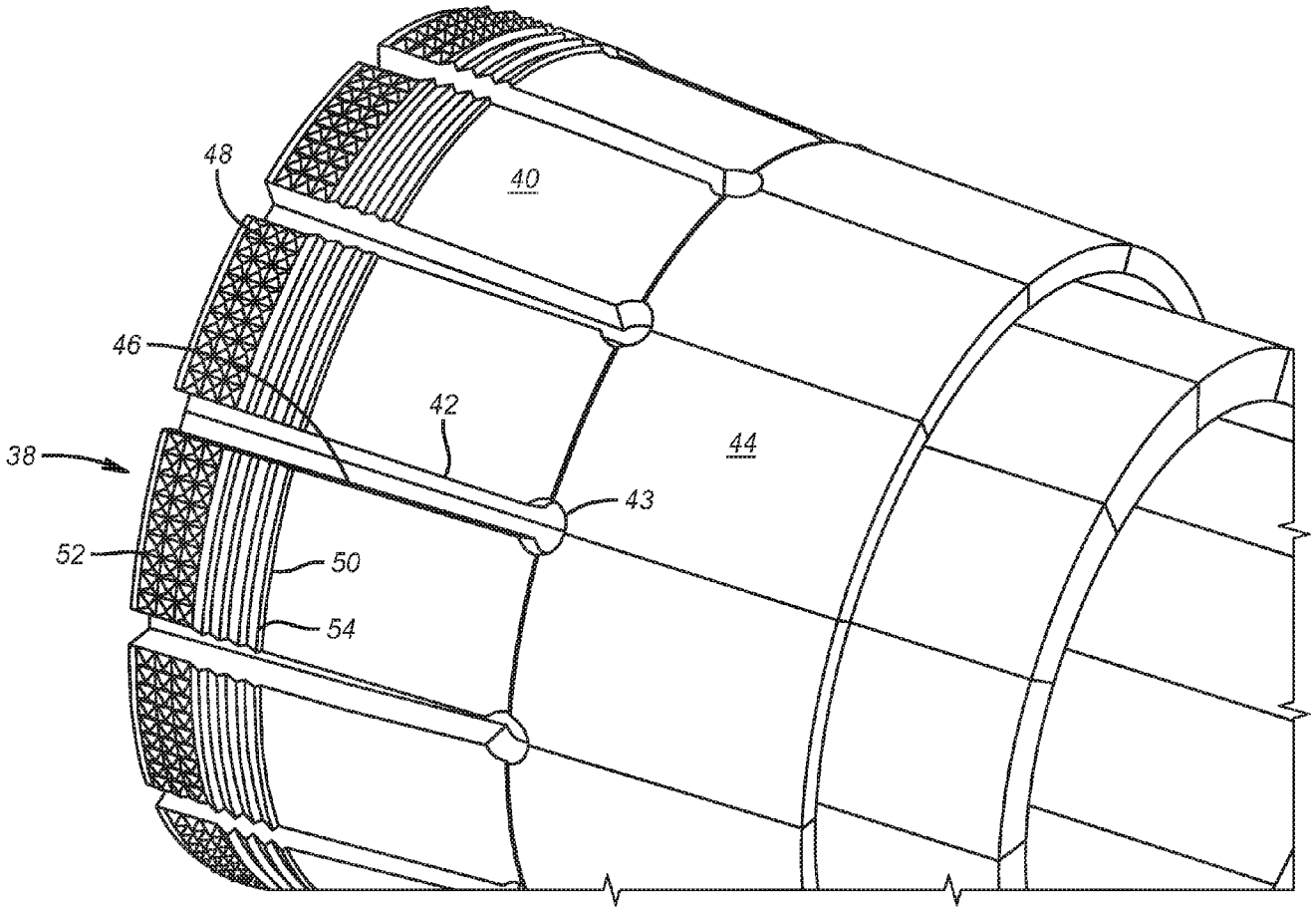
FIG. 3 is a perspective view of the setting sleeve in FIG. 1 focusing on its leading end.
Figure 4:
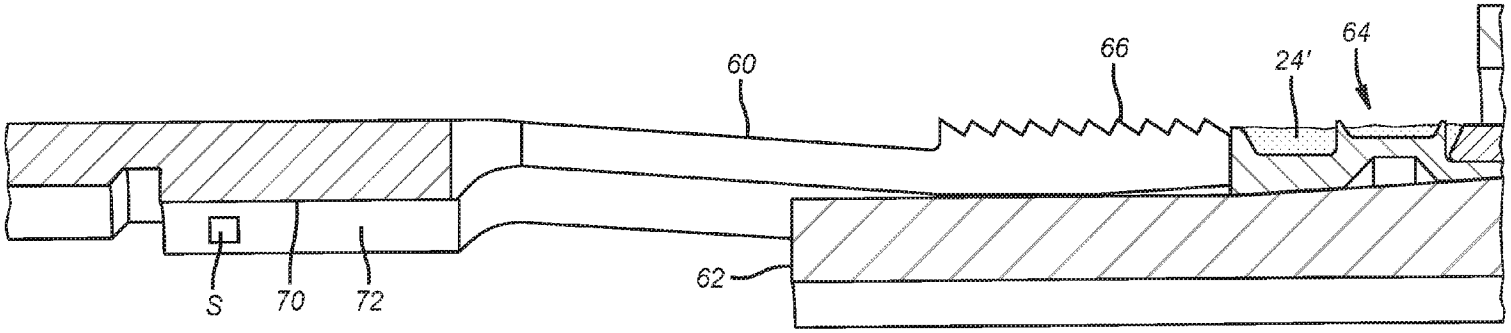
FIG. 4 shows, in the run in position, one design of a travel stop feature on a collet support ring for a tool set by expansion.
Figure 5:
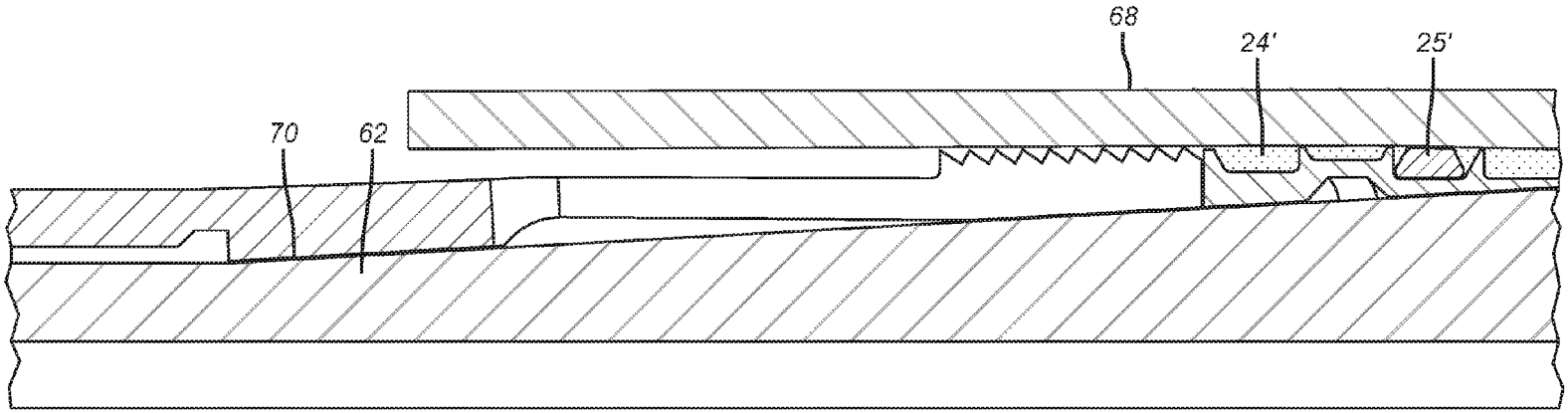
FIG. 5 is the view of FIG. 4 in the set position with the feature activated.

Specifically, the same structure described in detail in FIGS. 1-3 is again depicted in FIGS. 4 and 5 in the run in and set positions, respectively. The collet fingers 60 still ride up ramp surface 62 as before for the set position of the hanger/seal 64. Wickers 66 can be used to lock in the set position of the hanger/seal 64 against the surrounding tubular 68. However, to prevent excessive axial direction travel of the collets 60 which would create undue stress on the surrounding tubular 68 from the wickers 66 there is at least one inclined surface 70 that is configured to stay apart from the ramp surface 62 as the collets 60 move axially and the wickers 66 also move radially toward the surrounding tubular 68. As shown in FIG. 5 at some point the surface or surfaces 70 engage the ramp surface 62 and that is when a much higher force is needed to continue axial and hence radial movement of the wickers 66 that have engaged or penetrated the wall of the surrounding tubular 68. Surface 70 can be a continuous 360 degree inclined surface or it can be a series of circumferentially spaced segments. In either case surface 70 can be in a single row or in axially spaced rows. The segments as between rows can be aligned or offset. The height in the axial direction can be sized to control the localized contact stresses. The mating surfaces 62 and 70 or one of them can have an insert or a coating or the surfaces themselves can made of a lubricious material to protect surfaces 70 and 62 from wear or to decrease sliding friction between them in applications where the tool needs to be released with reverse movement of the movement used for setting such as depicted in FIGS. 4 and 5 for a permanently set tool. On the other hand, where no release is contemplated there can also be a ratchet feature that allows some movement under increasing force but with a lock against reverse movement. This ratchet can be in addition to or in place of the wickers 66 that are intended to lock in the set position. While depicted in FIGS. 4 and 5 with the locking feature of the wickers 66 the travel stop to radial movement can be used independently of such wickers 66 and in other tools than hanger/seal 64. Other tools can be adjustable swages or screens, to name a few examples. While the surfaces 62 and 70 are preferably parallel there can be some angular offset between them that can be tolerated. While parallel surfaces or substantially parallel surfaces defined as within 5 degrees of slope to each other can come into contact for the travel stop as depicted there can be other ways to have an axial and hence radial extension travel stop. For example the ramp surface 62 can have a projection that is abutted by another projection on the collet 60. There can be single or multiple rows of such projections which can be segments or 360 degree ribs. There can also be multiple engagements so as to leave open an option to increment the axial movement and radial extension even after the high load situation is detected if for any reason additional radial extension of the tool still is warranted when the signal arises. Alternatively there can be a combination of projection and depression that come into registry after a predetermined axial movement. In another variation one of the relatively moving components can have a groove and the other a snap ring that when aligned with the groove snaps into it to lock the two components together. Load sensors S can be used to transmit in real time the information that further relative axial movement has stopped due to the force required from engagement of surfaces 62 and 70. The hanger/seal assembly 64 has seals 24' and optionally a radial travel stop 25' embedded in seal 24'.

Figure 2:
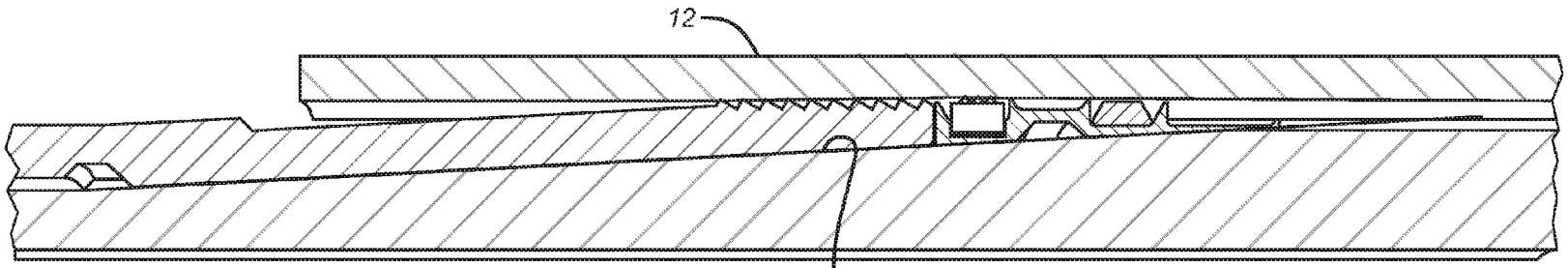
FIG. 2 is the view of FIG. 1 in the set position.
Figure 6:
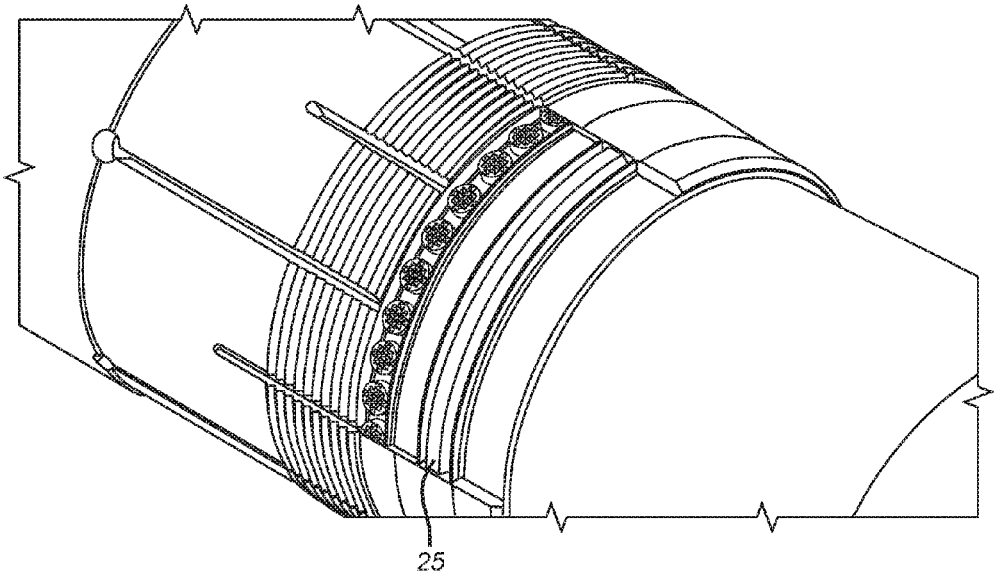
FIG. 6 is a perspective view of the view of FIG. 1 also incorporating a travel stop in the expanding seal.
Figure 7:
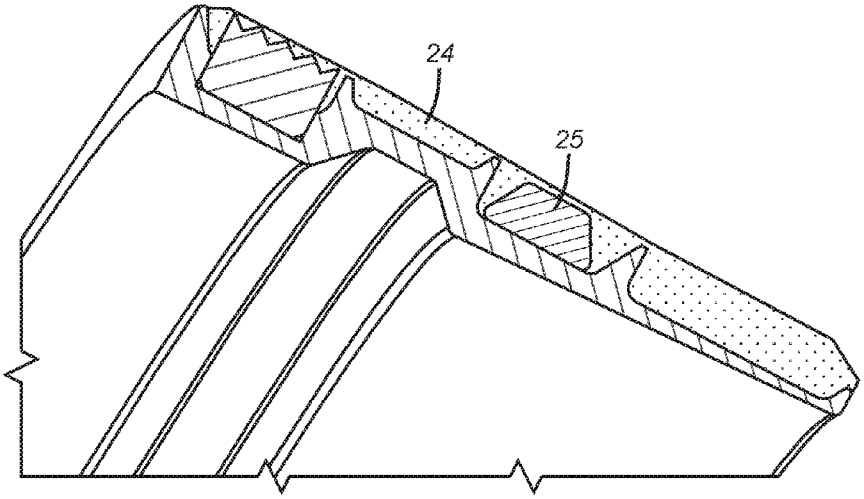
FIG. 7 is a section view of the expanding seal in FIG. 6 showing the travel stop in more detail.

FIGS. 6 and 7 show the device in FIGS. 1-3 in different perspectives to illustrate the placement of the travel stop 25 embedded in a seal 24 between ribs 30 and 32.

Figure 8:
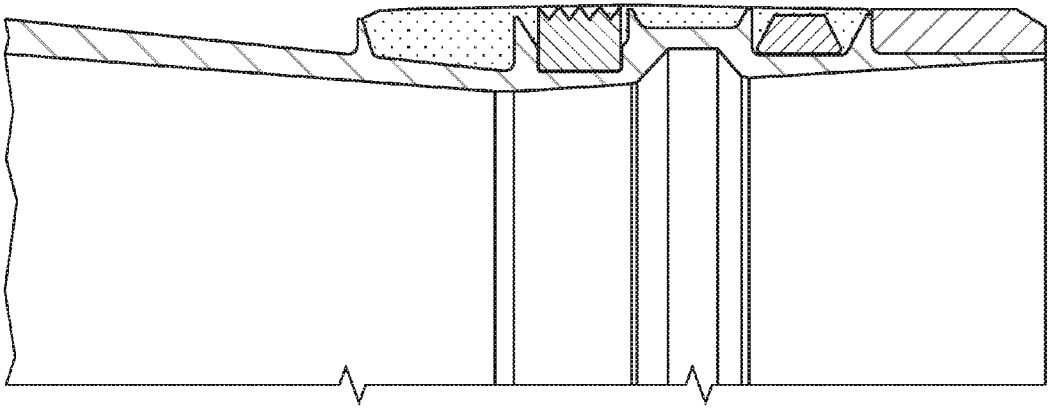
FIG. 8 is a section view of a travel stop incorporated into an expanding anchor/seal.
Figure 9:
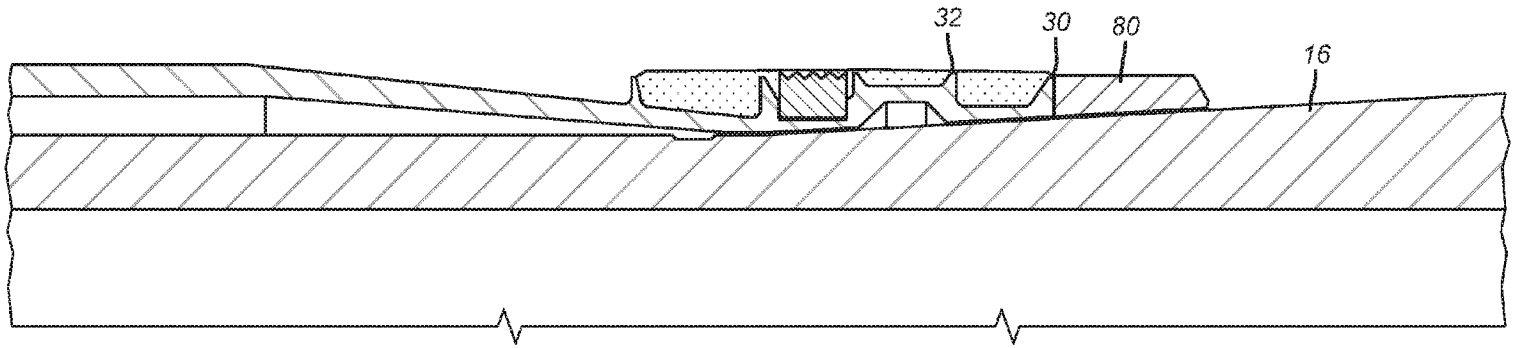
FIG. 9 is an alternative embodiment to FIG. 8 locating the travel stop ahead of the hanger/seal.

FIG. 8 is another view of the hanger/seal 10 shown in FIG. 1 with the radial travel stop 24 located between ribs 30 and 32. As an alternative travel stop, the hanger/seal 10 can have a leading ring ahead of rib 30 in going up the ramp 16. Ring 80 can have weak segments so that the incremental effort to expand it is minimized with the travel up the ramp simply breaking those intentionally weak bonds between the segment until such time the segments are pushed far enough up the ramp 16 to engage the surrounding tubular and act as a radial travel stop. Alternatively, ring 80 can be segments held to ramp 16 by a band spring to keep them together but to let them easily ride up ramp 16 with minimal incremental force.

The above description is illustrative of the preferred embodiment and many modifications may be made by those skilled in the art without departing from the invention whose scope is to be determined from the literal and equivalent scope of the claims below:

We claim:

1. An assembly for subterranean use to support a first tubular from a surrounding tubular, comprising:

a mandrel supporting the first tubular and further comprising a ramp;

a ring-shaped anchor or seal assembly surrounding said ramp and slidably mounted to said ramp, said anchor or seal assembly having an upper end;

an actuating sleeve on said mandrel, having a radially discrete lower end abutting said upper end of said anchor or seal assembly, said anchor or seal assembly relatively movable with respect to and on said ramp to expand said ring-shaped anchor or seal assembly into the surrounding tubular and lock the position of said mandrel to the surrounding tubular with a locking member on said actuating sleeve wedging between said ramp and the surrounding tubular after said relative movement of said actuating sleeve with respect to said ramp puts said ring-shaped anchor or seal assembly in contact with the surrounding tubular.

2. The assembly of claim 1, wherein:

said actuating sleeve contacts the surrounding tubular as or after at least a portion of the anchor or seal assembly contacts the surrounding tubular.

3. The assembly of claim 2, wherein:

said actuating sleeve further comprises an external surface condition that contacts the surrounding tubular.

4. The assembly of claim 3, wherein:

said external surface condition abuts or penetrates the surrounding tubular.

5. The assembly of claim 4, wherein:

said external surface condition comprises at least one rib.

6. The assembly of claim 5, wherein:

said at least one rib comprises a plurality of ribs, said ribs arranged to be at least one of or combinations of circumferentially; axially; parallel or non-parallel to each other; intersecting each other; or extending continuously or in segments.

7. The assembly of claim 6, wherein:

said external surface condition comprises at least one carbide button.

8. The assembly of claim 7, wherein:

said actuating sleeve having a leading end weakening feature to promote movement of said actuating sleeve along said ramp.

9. The assembly of claim 8, wherein:

said weakening feature comprises slots or scores.

10. The assembly of claim 9, wherein:

said slots or scores define spaced fingers that flex to an angle of said ramp.

11. The assembly of claim 10, wherein:

said slots or scores are generally axially oriented.

12. The assembly of claim 11, wherein:

said slots or scores extend from an end of said actuating sleeve that is adjacent to said anchor or seal assembly.

13. The assembly of claim 4, wherein:

said external surface condition comprises at least one carbide button.

14. The assembly of claim 13, wherein:

said at least one carbide button comprises a plurality of carbide buttons in at least one row or randomly arranged.

15. The assembly of claim 2, wherein:

said actuating sleeve abuts or penetrates the surrounding tubular.

16. The assembly of claim 2, wherein:

said actuating sleeve having a leading end weakening feature to promote movement of said actuating sleeve along said ramp.

17. The assembly of claim 16, wherein:

said weakening feature comprises slots or scores.

18. The assembly of claim 17, wherein:

said slots or scores define spaced fingers that flex to an angle of said ramp.

19. The assembly of claim 18, wherein:

said slots or scores are generally axially oriented.

20. The assembly of claim 19, wherein:

said slots or scores extend from an end of said actuating sleeve that is adjacent to said anchor or seal assembly.

21. The assembly of claim 20, wherein:

said slots or scores have a drill hole located on an end of at least one of said slots or scores that is opposite said anchor or seal assembly.

* * * * *